US008020731B2

(12) United States Patent
McCullough et al.

(10) Patent No.: US 8,020,731 B2
(45) Date of Patent: Sep. 20, 2011

(54) DISPENSER

(75) Inventors: Anthony McCullough, Greensboro, NC (US); Ron Shuster, Greensboro, NC (US); Lori Huffman, Greensboro, NC (US)

(73) Assignee: Evonik Stockhausen, LLC, Greensboro, NC (US)

( * ) Notice: Subject to any disclaimer, the term of this patent is extended or adjusted under 35 U.S.C. 154(b) by 528 days.

(21) Appl. No.: 12/022,212

(22) Filed: Jan. 30, 2008

(65) Prior Publication Data

US 2009/0188943 A1 Jul. 30, 2009

(51) Int. Cl.
*B67D 7/06* (2010.01)

(52) U.S. Cl. ..... 222/180; 222/153.01; 248/551

(58) Field of Classification Search ..... 222/153.01, 222/173, 180; 248/551, 640, 678, 680
See application file for complete search history.

(56) References Cited

U.S. PATENT DOCUMENTS

| | | | | | |
|---|---|---|---|---|---|
| 231,597 | A * | 8/1880 | Matthews | 222/173 |
| 3,845,884 | A * | 11/1974 | Hall et al. | 222/173 |
| 4,258,854 | A * | 3/1981 | Wright | 215/21 |
| 4,869,381 | A * | 9/1989 | Agner | 215/11.1 |
| 5,148,948 | A * | 9/1992 | Granville et al. | 222/173 |
| 5,445,288 | A | 8/1995 | Banks | |
| 5,480,068 | A | 1/1996 | Frazier et al. | |
| 5,829,607 | A | 11/1998 | Ibrahim | |
| 6,082,586 | A | 7/2000 | Banks | |
| 6,142,342 | A * | 11/2000 | Lewis | 222/180 |
| 6,250,470 | B1 * | 6/2001 | Mackenzie | 206/579 |
| 6,398,050 | B1 | 6/2002 | Allora | |
| D470,401 | S * | 2/2003 | Genoa et al. | D9/503 |
| 6,520,470 | B1 * | 2/2003 | Chan | 248/346.04 |
| 6,705,492 | B2 | 3/2004 | Lowry | |
| 6,820,770 | B2 * | 11/2004 | Makino et al. | 222/180 |
| 6,905,038 | B2 | 6/2005 | Lopez | |
| 6,910,604 | B2 | 6/2005 | Gugliotti et al. | |
| 2002/0070238 | A1 * | 6/2002 | Pritchett et al. | 222/189.11 |
| 2006/0144861 | A1 | 7/2006 | Harrison et al. | |

FOREIGN PATENT DOCUMENTS

| | | | |
|---|---|---|---|
| EP | 1103212 | A1 | 5/2001 |
| GB | 2414466 | A | 11/2005 |
| GB | 2435874 | A | 9/2007 |
| WO | 2004/004529 | A1 | 1/2004 |

OTHER PUBLICATIONS

International Search Report mailed on May 6, 2009 in PCT/US2009/032244.
Written Opinion mailed on May 6, 2009 in PCT/US2009/032244.

* cited by examiner

*Primary Examiner* — Kevin P Shaver
*Assistant Examiner* — Andrew Bainbridge
(74) *Attorney, Agent, or Firm* — Smith Moore Leatherwood LLP

(57) ABSTRACT

A fluid dispenser formed of a bottle for housing the fluid, a discharge mechanism for discharging fluid from the bottle, and a protrusion that is connected to and extends from the bottom of the bottle. The protrusion has a diameter that is smaller than the diameter of the bottom wall of the bottle. The bottle is capable of standing upward on a horizontal surface without the use of a separate base or mount when the protrusion extends into an aperture in the horizontal surface such that the bottom wall of the bottle rests on the horizontal surface.

14 Claims, 3 Drawing Sheets

DISPENSER

The present invention is directed towards a dispenser that can be mounted on a countertop.

BACKGROUND OF THE INVENTION

Many public bathrooms in business establishments such as offices and restaurants have soap dispensers that include soap-filled bottles mounted under the counter next to the sinks. The dispensers have spouts that are disposed above the counter and are attached to the under-mounted bottles so that soap can be pumped from the respective bottles. Typically, large holes are bored into the counter so that the spout and bottle can be securely attached to one another to form the dispenser assembly. There are several drawbacks to this type of dispenser assembly. First, it is difficult to determine when the under-mounted soap bottle is empty or running low on soap because the bottle is not visible above the counter. Typically, a person has to go underneath the counter and unscrew the bottle to determine the amount of soap in it, which is labor-intensive and can be unsanitary. Also, the soap bottles are typically not disposable and must be refilled with soap. The process of pouring soap into the bottles can also be labor-intensive and messy.

Many operators of public bathrooms have explored replacing the prior art soap dispensers as described above with new soap dispensers that do not have the noted drawbacks. For example, some operators have used stand-alone soap dispensers that rest on top of but are not affixed to the countertop. Those dispensers, however, are often stolen by consumers who use them in their homes. Further, when the prior art dispensers are replaced with new means for delivering soap, the hole in the counter from the prior art dispenser remains and can be very unattractive.

Accordingly, there is a need in the art for a soap dispenser system that can easily be refilled or replaced and that utilizes existing counter holes that were used for the prior art soap dispensers.

DETAILED DESCRIPTION OF THE INVENTION

The present invention is a dispenser, such as a soap dispenser, that is easy to replace or refill and may fit into holes in counters that were utilized for prior art soap dispenser systems.

Figure 1:
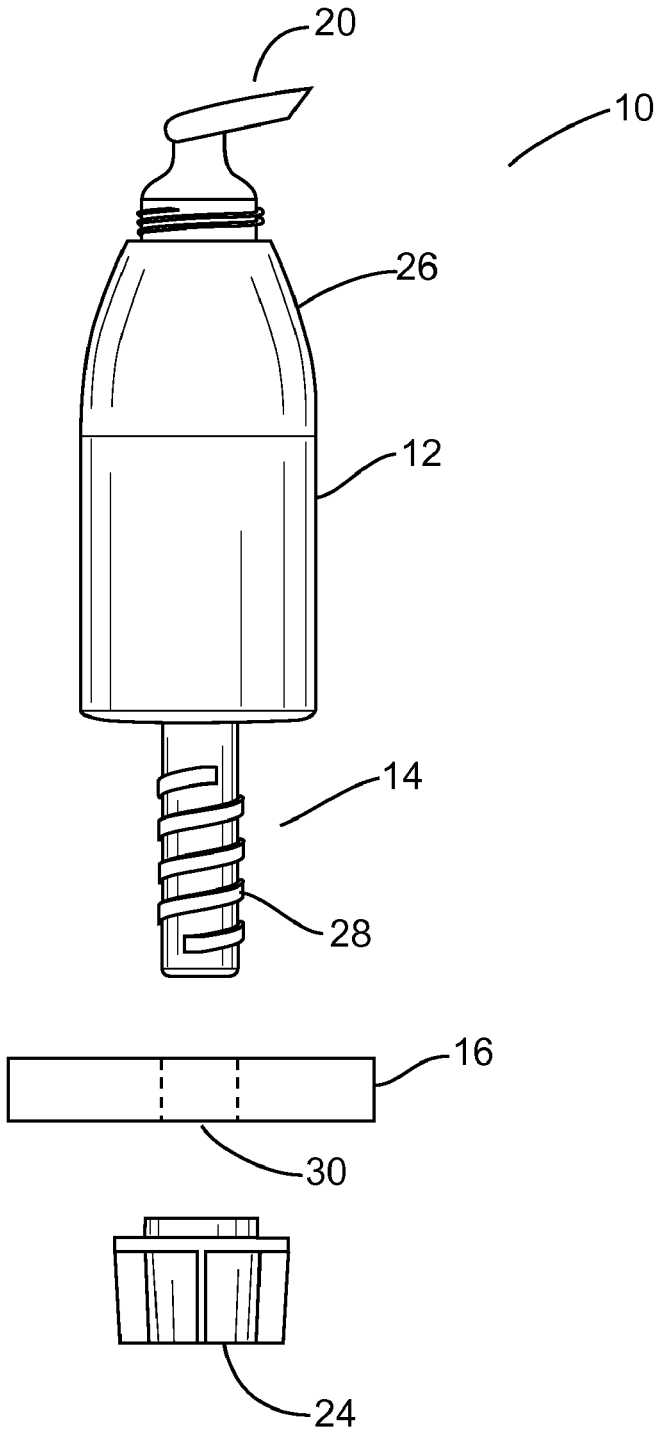
FIG. 1 is an exploded perspective view of a dispenser in accordance with the present invention.
Figure 2:
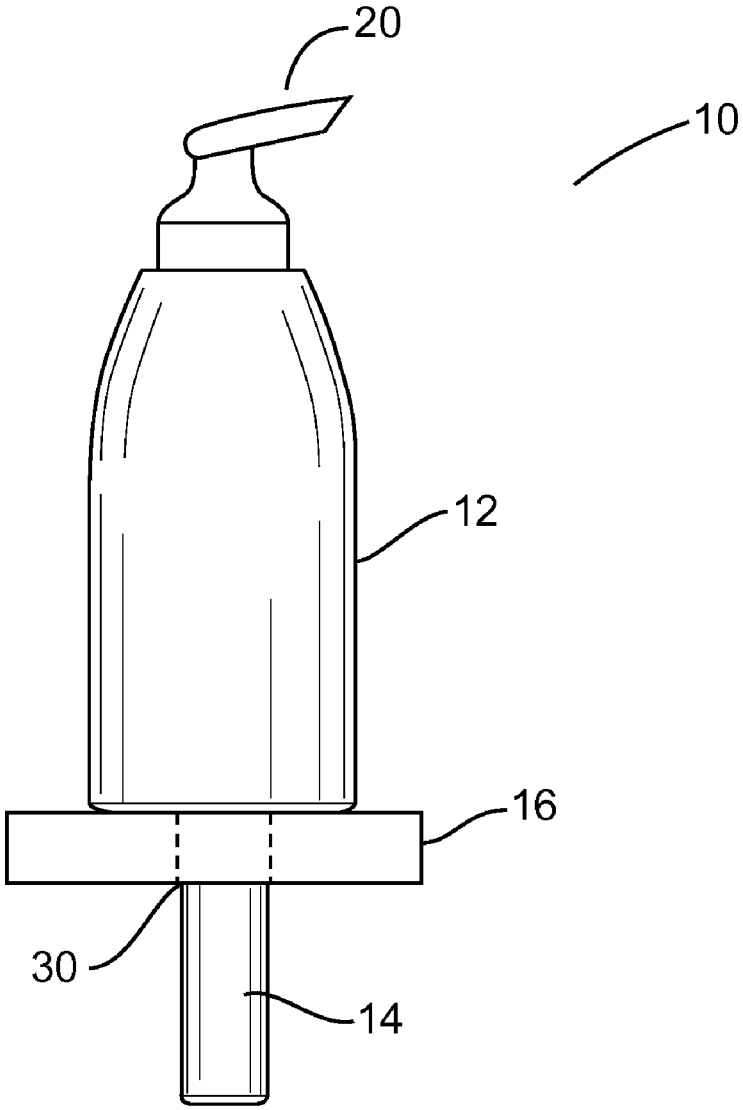
FIG. 2 is a perspective view of an installed dispenser in accordance with the present invention.
Figure 3:
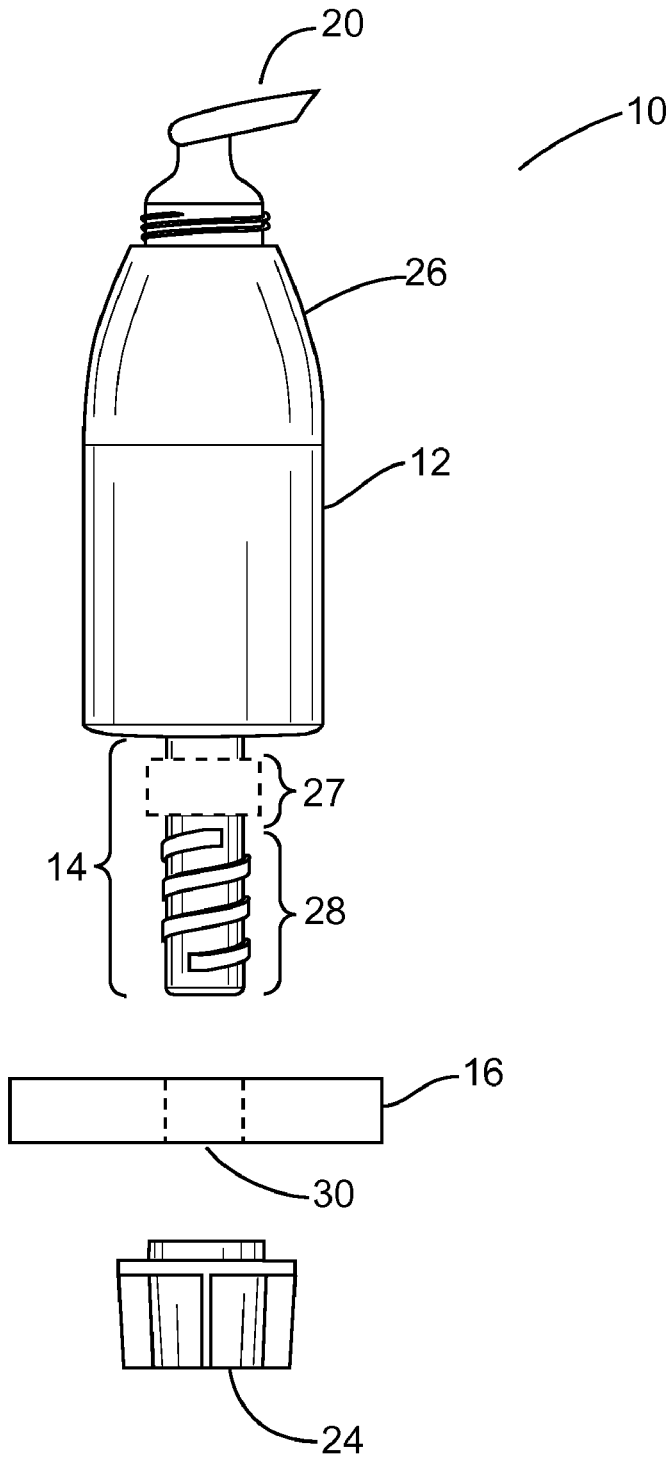
FIG. 3 is an exploded perspective view of a dispenser in accordance with one embodiment of the present invention.

As shown in FIGS. 1 and 2, the dispenser 10 of the present invention includes a bottle 12, a discharge mechanism such as a spout 20 or a foaming pump that may be removably or permanently attached to the bottle 12, and protrusion such as an elongated stud 14 that extends from the bottom 22 of the bottle 12. When the dispenser 10 of the present invention is installed, the elongated stud 14 may be inserted into the hole 30 in the counter 16 that may have been previously bored to accommodate a prior art dispenser assembly. The elongated stud 14 may be long enough to extend below the depth of the counter 16 so that the bottom 22 of the bottle 12 rests flush on top of the counter 16.

Because the bottle 12 rests on top of the counter 16, an operator may easily determine if the bottle 12 is empty or running low on soap without having to go underneath the counter 16 to view and/or remove the bottle 12. For example, in one aspect of the present invention, the bottle 12 may be formed of transparent or semi-transparent material so that the amount of soap within the bottle 12 may be easily viewed above the counter 16. It should be understood, however, that the components of the dispenser 10 of the present invention may be formed of any type of material, such as plastic, glass, or metal. In another aspect of the present invention, the operator may remove the spout 20 from the bottle 12 to look into the bottle 12 to determine the amount of soap therein without having to go under the counter 16. When the dispenser 10 of the present invention is empty, the operator may easily replace the entire dispenser 10 with a new dispenser that may be pre-filled with soap or liquid. If the operator desires to refill the bottle 12, he or she may simply remove the spout 20 and refill the bottle 12 on top of the counter 16. Therefore, the operator is able to easily replace or refill the dispenser 10 without having to go underneath the counter.

The dispenser 10 of the present invention is also theft-deterrent in that the elongated stud 14 makes it difficult for a consumer to use the dispenser 10 in a different location because the dispenser 10 is not stable resting on top of a planar surface that doesn't have a hole through which the elongated stud 14 can extend.

In one embodiment of the present invention, the elongated stud 14 may be ribbed 27 to create a frictional engagement between the stud 14 and the hole 30 in the counter 16. The elongated stud 14 may also be threaded 28 so that it can be screwed into a wing nut 24 underneath the counter 16 to provide an additional means of securing the dispenser 10 to the counter 16. The wing nut 24 may also help to center the stud 14 in the hole 30 if the diameter of the hole 30 is bigger than the diameter of the stud 14.

In another embodiment of the present invention, the upper portion 26 of the bottle 12 is tapered towards the spout 20 so that the user's hands are able to fit under the spout 20 when the soap is dispensed from the bottle 12.

It should be understood that the dispenser 10 of the present invention is not limited to dispensing soap. Rather, the dispenser 10 may dispense any type of fluid or semi-fluid material.

In view of the foregoing, the dispenser of the present invention is easy to replace or refill without having to go underneath the counter. The dispenser of the present invention may also be used to replace a prior art dispenser by utilizing the existing hole bored in the counter for the prior art dispenser. Thus, the dispenser of the present invention does not require use of a separate mount or base to hold or support the dispenser.

Certain modifications and improvements will occur to those skilled in the art upon a reading of the forgoing description. All such modifications and improvements of the present invention have been deleted herein for the sake of conciseness and readability.

What is claimed is:

1. A device for dispensing fluid comprising:

a bottle for housing the fluid, the bottle having a bottom wall;

a discharge mechanism that is configured to discharge fluid from the bottle;

a protrusion that is connected to and extends from the bottom wall of the bottle, the protrusion having a diameter that is smaller than the diameter of the bottom wall of the bottle;

wherein the bottle is adapted to stand upward on a horizontal surface without the use of a separate base when the protrusion extends into an aperture in the horizontal surface such that the bottom wall of the bottle rests on the horizontal surface; and wherein the outside of the protrusion is ribbed to create a frictional engagement when the protrusion is removably inserted into the aperture in the horizontal surface wherein said horizontal surface has depth, and said protrusion is adapted to extend beyond said depth.

2. The device of claim 1 wherein the bottle is prevented from stably standing upward on a horizontal surface unless the protrusion extends into the horizontal surface such that the bottom wall of the bottom rests on the horizontal surface.

3. The device of claim 1 wherein the discharge mechanism is removably or permanently connected to the bottle.

4. The device of claim 1 wherein the bottle is formed of a transparent or semi-transparent material such that the amount of fluid in the bottle is viewable from the outside of the bottle.

5. The device of claim 1 wherein the bottle, discharge mechanism, and protrusion are formed of material selected from the group consisting of metal, glass, and plastic.

6. The device of claim 1 wherein the bottle is pre-filled with fluid.

7. The device of claim 1 wherein the protrusion is integrally formed with the bottom wall of the bottle.

8. The device of claim 1 wherein the protrusion comprises a separate unit that is attached to the bottom wall of the bottle.

9. A device for dispensing fluid comprising:

a bottle for housing the fluid, the bottle having a bottom wall;

a discharge mechanism that is configured to discharge fluid from the bottle;

a protrusion that is connected to and extends from the bottom wall of the bottle, the protrusion having a diameter that is smaller than the diameter of the bottom wall of the bottle;

wherein the bottle is adapted to stand upward on a horizontal surface without the use of a separate base when the protrusion extends into an aperture in the horizontal surface such that the bottom wall of the bottle rests on the horizontal surface;

wherein the outside of the protrusion is ribbed to create a frictional engagement when the protrusion is removably inserted into the aperture in the horizontal surface;

wherein the protrusion further comprises external threads; and wherein the device further comprises a wing nut comprising internal threads that is adapted to removably, threadably mount onto the protrusion underneath the horizontal surface to secure the position of the device.

10. The device of claim 1 wherein an upper portion of the bottle is tapered towards the discharge mechanism to enable a user's hands to fit under the discharge mechanism during use of the device.

11. The device of claim 1 wherein the discharge mechanism is a spout.

12. The device of claim 1 wherein the discharge mechanism is a foaming pump.

13. A method for installing a fluid dispenser on a horizontal surface having an aperture comprising the steps of:

providing a fluid dispenser comprising:

a bottle for housing the fluid, the bottle having a bottom wall;

a discharge mechanism that is configured to discharge fluid from the bottle; and a protrusion that is connected to and extends from the bottom wall of the bottle;

inserting the protrusion into the aperture in the horizontal surface such that the bottom wall of the bottle rests on the horizontal surface and the bottle is adapted to stand upward on the horizontal surface without the use of a separate base or mount;

wherein the outside of the protrusion is ribbed to create a frictional engagement when the protrusion is removably inserted into the aperture in the horizontal surface wherein said horizontal surface has depth, and said protrusion is adapted to extend beyond said depth.

14. A method for installing a fluid dispenser on a horizontal surface having an aperture comprising the steps of:

providing a fluid dispenser comprising:

a bottle for housing the fluid, the bottle having a bottom wall;

a discharge mechanism that is configured to discharge fluid from the bottle; and a protrusion that is connected to and extends from the bottom wall of the bottle;

inserting the protrusion into the aperture in the horizontal surface such that the bottom wall of the bottle rests on the horizontal surface and the bottle is adapted to stand upward on the horizontal surface without the use of a separate base or mount;

threading a wing nut onto the protrusion underneath the horizontal surface, the protrusion further comprising external threads; and wherein the outside of the protrusion is ribbed to create a frictional engagement when the protrusion is removably inserted into the aperture in the horizontal surface.

* * * * *